US007641004B2

(12) United States Patent
Lapointe

(10) Patent No.: US 7,641,004 B2
(45) Date of Patent: Jan. 5, 2010

(54) DRILL BIT

(75) Inventor: Paul-Philippe Lapointe, Montréal (CA)

(73) Assignee: Groupe Fordia Inc., St. Laurent (CA)

( * ) Notice: Subject to any disclaimer, the term of this patent is extended or adjusted under 35 U.S.C. 154(b) by 167 days.

(21) Appl. No.: 11/795,029

(22) PCT Filed: Jan. 16, 2006

(86) PCT No.: PCT/CA2006/000053

§ 371 (c)(1),
(2), (4) Date: Jul. 11, 2007

(87) PCT Pub. No.: WO2006/076795

PCT Pub. Date: Jul. 27, 2006

(65) Prior Publication Data

US 2008/0066969 A1 Mar. 20, 2008

Related U.S. Application Data

(60) Provisional application No. 60/644,369, filed on Jan. 18, 2005.

(51) Int. Cl.
*E21B 10/48* (2006.01)

(52) U.S. Cl. ..... 175/405.1; 175/432; 408/145

(58) Field of Classification Search ..... 175/405.1, 175/432, 332; 408/145
See application file for complete search history.

(56) References Cited

U.S. PATENT DOCUMENTS 4,208,154 A * 6/1980 Gundy ..... 408/204
5,025,871 A * 6/1991 Stewart et al. ..... 175/57

* cited by examiner

*Primary Examiner*—David J. Bagnell
*Assistant Examiner*—James G Sayre

(57) ABSTRACT

A bit for drilling a hole. The bit includes a support member, the support member having a passageway extending substantially longitudinally therethrough; a substantially annular crown defining a crown distal end and a crown proximal end, a radially inwardly located crown inner surface and a radially outwardly located crown outer surface, the crown extending from the support member; a slot extending between the crown inner and outer surfaces from the crown distal end substantially longitudinally towards the crown proximal end, the slot defining a slot first side wall, a substantially circumferentially opposed slot second side wall and a slot proximal wall extending therebetween substantially opposed the crown distal end; and a reinforcing member extending substantially circumferentially across the slot between the slot first and second walls; wherein the slot includes a slot proximal segment extending between the reinforcing member and the slot proximal wall and a slot distal segment extending between the reinforcing member and the crown distal end.

19 Claims, 5 Drawing Sheets

20
20c
20d
20e
20f
16
16
16
16
16

VI B
20g
20h
16
16

DRILL BIT

The present invention claims priority from Provisional Application Ser. No. 60/644,369 filed on Jan. 18, 2005.

FIELD OF THE INVENTION

The present invention relates to the general field of drilling, and is particularly concerned with a drill bit.

BACKGROUND OF THE INVENTION

In the geological exploration, mining and construction industries, among others, drill bits are used to drill through rock, concrete and other materials. Typically, these bits include a crown made of a mixture of metal and diamonds. This crown is the portion of the bit that erodes the material through which a bore is drilled.

Some bits include a central passageway through which water is injected. To let water and debris flow out of the drill's way, the crown typically includes a plurality of segments separated by openings.

The crown material used to manufacture the crowns of the bits is typically substantially harder than the material through which drilling is performed. However, this crown material is typically relatively brittle. Accordingly, the dimensions of the openings between the segments in the crown are limited by the brittleness of the material used to manufacture these crowns.

Indeed, if these openings extend too deep within the crown, there is a risk that a segment will be broken while drilling. In this case, there is a need to remove the bit from the drilling apparatus and to use a new bit.

Since these drill bits are relatively expensive, the size of the segments are typically limited in currently existing bits, as shallower openings between the segments render the latter typically less prone to being ruptured or otherwise damaged. This shallowness of openings is a desired characteristic as breaking a segment typically means that the whole bit must be discarded. In addition, the time required to remove the drill bit and to position the new bit inside the bore that was being bored is typically relatively long as the bit and drilling apparatus need to be removed entirely from this bore in order to replace the damaged bit.

However, bits including relatively shallow openings will be worn from drilling in a relatively short amount of time. Therefore, once more, there is a need to take time to remove the bit from the bore to drill at relatively short time intervals to replace the worn out drill bit.

U.S. Pat. No. 5,316,416 issued on May 31, 1994 to Kim describes a drill bit that attempts to alleviate this disadvantage of previously known drill bits. In this patent, a drill bit including a tool body having an open upper end and an annular diamond blade portion is described. The diamond blade portion includes an upper circumferential edge and a lower circumferential edge, the diamond blade portion being attached at the lower circumferential edge to the open upper end of the tool body. A plurality of upper cuts each extends downwardly from the upper circumferential edge of the diamond blade portion. The upper cuts terminate at a depth of the diamond blade portion above the lower circumferential edge. A plurality of lower slots each extends upwardly from the lower circumferential edge of the diamond blade portion and terminate at a height below the upper circumferential edge. The lower slots are positioned under and between the upper cuts and extend higher than the bottom of the upper cuts.

However, the configuration of this drill bit is not suitable for use in wet drilling wherein water is injected inside the drill bit during the drilling process. Indeed, the configuration of the cuts in this drill bit does not allow the water to flow radially outwardly towards the outside of the drill bit as no longitudinal passageways are present that would allow the water to move away from the crown of the drill bit after it exits the crown.

Another problem that sometimes occurs in prior art drill bit is that the drilling process may produce a radially uneven abrasion of the crown. In cases wherein this phenomenon occurs, the efficiency of the drilling process is reduced relatively to cases wherein the crown is abraded substantially uniformly.

Against this background, there exists a need in the industry to provide an improved drill bit.

OBJECT OF THE INVENTION

An object of the present invention is therefore to provide an improved drill bit.

SUMMARY OF THE INVENTION

In a broad aspect, the invention provides a bit for drilling a hole. The bit includes:

- a support member, the support member defining a support member proximal end and a substantially longitudinally opposed support member distal end, the support member having a passageway extending substantially longitudinally therethrough;
- a substantially annular crown defining a crown distal end and an opposed crown proximal end, a radially inwardly located crown inner surface and a radially outwardly located crown outer surface, a crown inner diameter and a crown outer diameter, the crown extending from the support member such that the crown proximal end is located substantially adjacent the support member distal end;
- a slot extending between the crown inner and outer surfaces from the crown distal end substantially longitudinally towards the crown proximal end, the slot defining a slot first side wall, a substantially circumferentially opposed slot second side wall and a slot proximal wall extending therebetween substantially opposed the crown distal end; and
- a reinforcing member extending substantially circumferentially across the slot between the slot first and second side walls;
- wherein the slot includes a slot proximal segment extending between the reinforcing member and the slot proximal wall and a slot distal segment extending between the reinforcing member and the crown distal end.

In a variant, the bit includes a plurality of slots each having a reinforcing member extending substantially circumferentially thereacross. The slots define a plurality of drilling segments, the reinforcing members interconnecting the segments.

Advantageously, the reinforcing members increase the robustness of the segments. Accordingly; such segments can extend longitudinally away from the support over a greater distance than in drill bits wherein reinforcing members are not provided. These segments are relatively less prone to failure than non-reinforced segments and allow for manufacturing drill bits having a relatively longer useful life because of the presence of the reinforcing members.

In addition, in some embodiments of the invention, the reinforcing members allow for the correction of an uneven abrasion of the segments.

The bit is relatively easy to manufacture and is typically compatible with existing drilling equipments and methods. In some embodiments of the invention, the manufacturing method used to manufacture the crown causes deviations in the shape of the crown from a perfectly annular shape to be relatively small.

In another broad aspect, the invention provides a bit for drilling a hole. The bit includes:

a support member, the support member defining a support member proximal end and a substantially longitudinally opposed support member distal end, the support member having a passageway extending substantially longitudinally therethrough;

a substantially annular crown defining a crown distal end and an opposed crown proximal end, a radially inwardly located crown inner surface and a radially outwardly located crown outer surface, a crown inner diameter and a crown outer diameter, the crown having a crown radial thickness equal to a difference between the crown outer and inner diameters, the crown extending from the support member such that the crown proximal end is located substantially adjacent the support member distal end;

a slot extending between the crown inner and outer surfaces from the crown distal end substantially longitudinally towards the crown proximal end, the slot defining a slot first side wall, a substantially circumferentially opposed slot second side wall and a slot proximal wall extending therebetween substantially opposed the crown distal end; and a reinforcing member extending substantially circumferentially across the slot between the slot first and second side walls, the reinforcing member extending substantially radially within the slot over a reinforcing member radial extension, the reinforcing member radial extension being substantially smaller than the crown radial thickness.

Other objects, advantages and features of the present invention will become more apparent upon reading of the following non-restrictive description of preferred embodiments thereof, given by way of example only with reference to the accompanying drawings.

DETAILED DESCRIPTION

Figure 1:
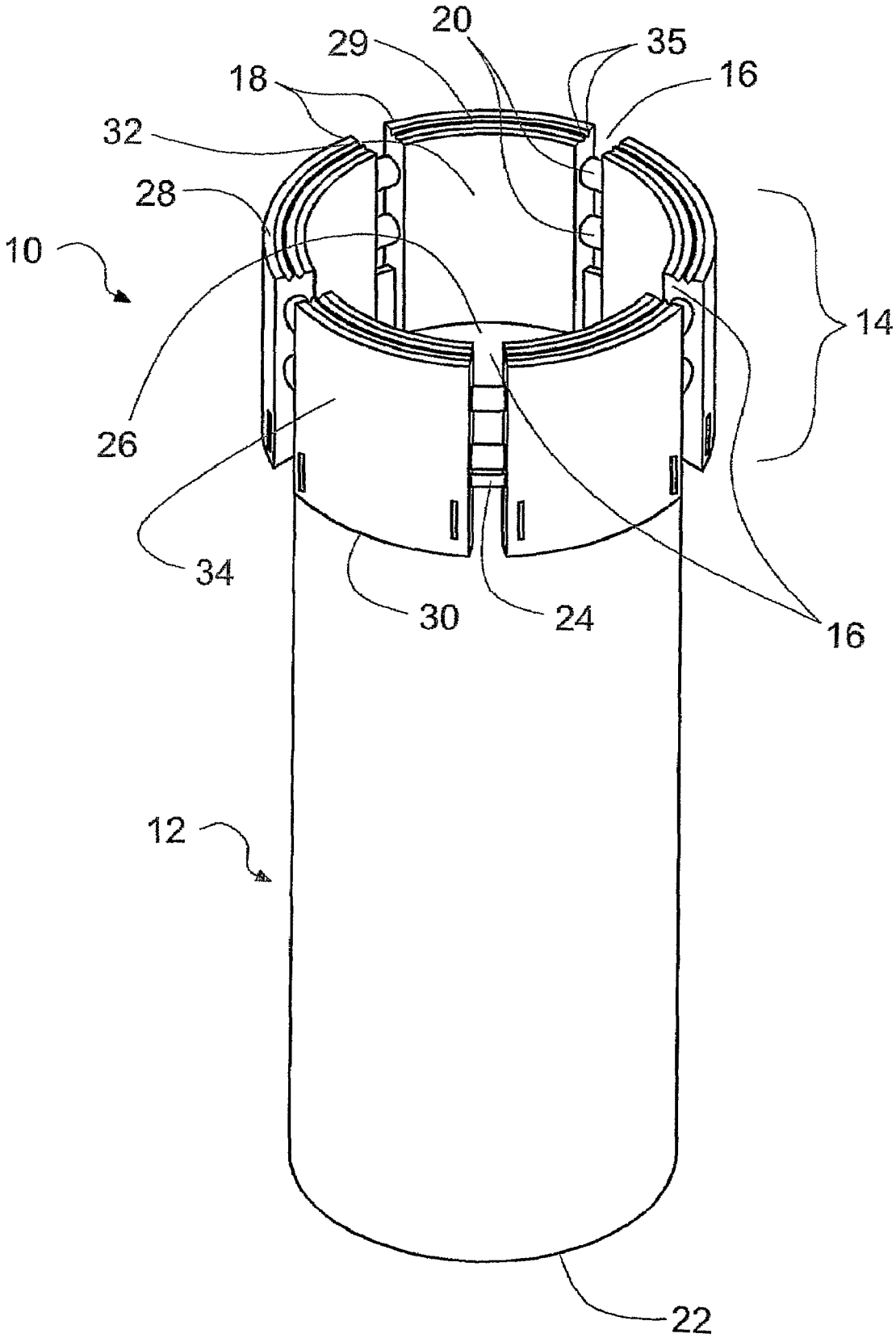
FIG. 1, in a perspective view, illustrates a bit for drilling a hole in accordance with an embodiment of the present invention.

FIG. 1 illustrates a bit 10 for drilling a hole (not shown in the drawings). The bit 10 includes a support member 12 and a crown 14 extending from the support member 12. A plurality of slots 16 is formed into the crown 14 and defines a plurality of drilling segments 18. The bit 10 further includes a plurality of reinforcing members 20, each reinforcing member 20 extending between adjacent segments 18.

The reinforcing members 20 improve the structural integrity of the crown 14. Therefore, the crown 14 may extend longitudinally from the support member 12 over a distance that is larger than distances that would be achievable using prior art crown configurations.

Although the crown 14 shown in the drawings includes 5 slots, it is within the scope of the invention to have crowns that include fewer or more slots. Furthermore, in some embodiments of the invention, only one slot is formed into a crown of a bit.

The support member 12 defines a support member proximal end 22 and a substantially longitudinally opposed support member distal end 24. The support member 12 has a passageway 26 extending substantially longitudinally therethrough. In some embodiments of the invention, the support member 12 is substantially tubular and cylindrical. In these embodiments, the support member 12 defines support member internal and external diameters.

The crown 14 is substantially annular and defines a crown distal end 28 and an opposed crown proximal end 30, a crown distal surface 29 at the crown distal end 28, a radially inwardly located crown inner surface 32 and a radially outwardly located crown outer surface 34, a crown inner diameter and a crown outer diameter. The crown 14 has a crown radial thickness equal to a difference between the crown outer and inner diameters. The crown 14 extends from the support member 12 such that the crown proximal end 30 is located substantially adjacent the support member distal end 24.

The crown inner and outer surfaces 32 and 34 are substantially cylindrical. However, in alternative embodiments of the invention, the crown inner and outer surfaces 32 and 34 have any other suitable shape.

In some embodiments of the invention, the crown distal surface 29 is substantially perpendicular to the crown inner and outer surfaces 32 and 34. Also, while not necessarily present in all embodiments of the invention, two substantially annular circumferential grooves 35 are formed into the crown distal surface 29. The grooves 35 have a substantially V-shaped cross-section.

Figure 2:
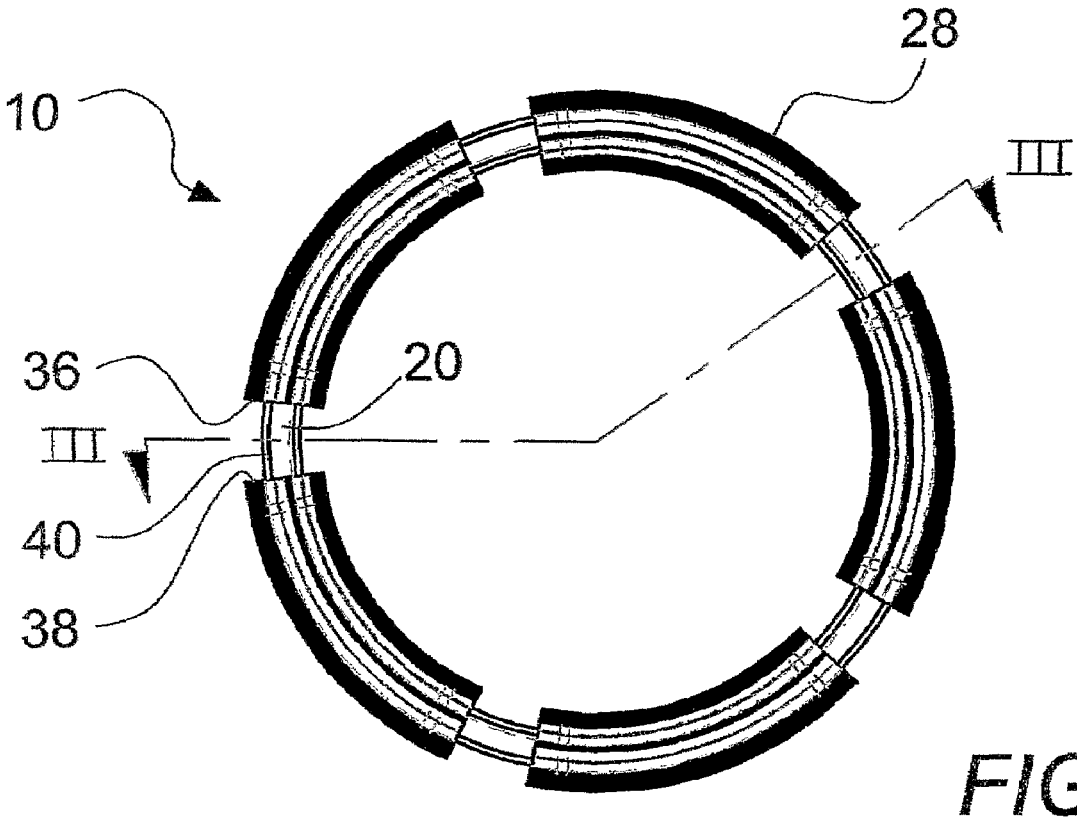
FIG. 2, in a top elevation view, illustrates the bit of FIG. 1.
Figure 3:
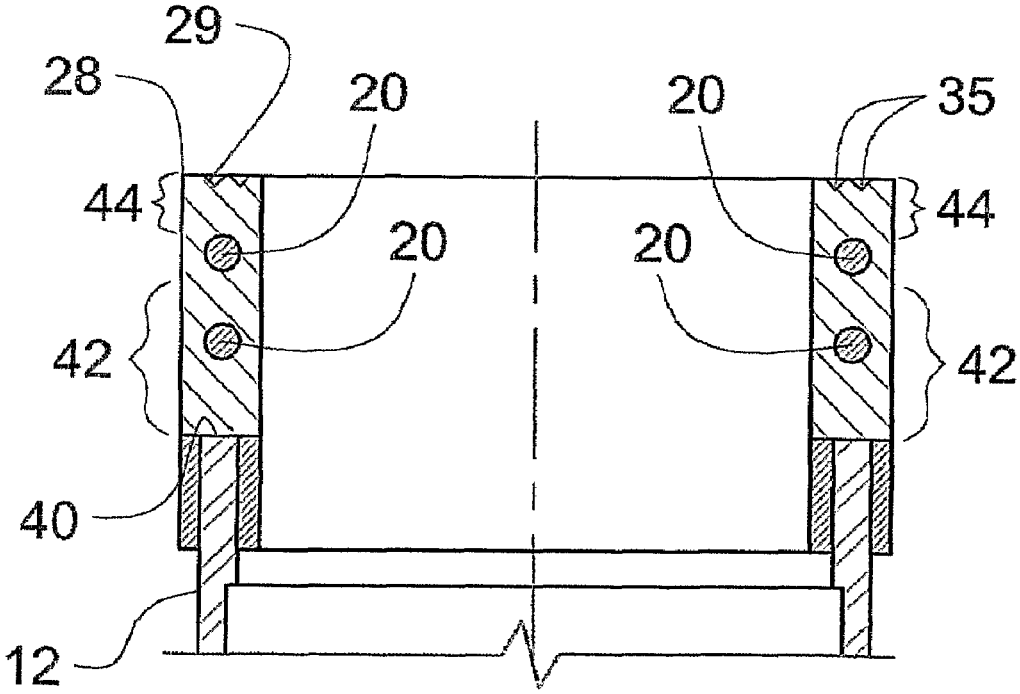
FIG. 3, in a partial side cross-sectional view along the line III-III of FIG. 2, illustrates the bit of FIG. 1.

In some embodiments of the invention, as better seen from FIGS. 2 and 3, the crown outer diameter is substantially larger than the support member outer diameter and the crown inner diameter is substantially smaller than the support member inner diameter. In these embodiments, the slots 16 allow the passage of water from the passageway 26, into the slots 16 and outside of the support member 12. However, in other embodiments of the invention no water is used for drilling and the crown 14 may then have radial dimensions substantially similar to the radial dimensions of the support member 12.

The slots 16 extend between the crown inner and outer surfaces 32 and 34 from the crown distal end 28 substantially longitudinally towards the crown proximal end 30. As better seen in FIG. 2, the slots 16 each define a slot first side wall 36, a substantially circumferentially opposed slot second side wall 38 and a slot proximal wall 40 extending therebetween substantially opposed the crown distal end 28. The slot first and second side walls 36 and 38 extend substantially radially. In some embodiments of the invention, the slot proximal wall 40 is defined by the support member 12. However, in other embodiments of the invention, the slot proximal wall 40 is formed by the crown 14 (this embodiment not being shown in the drawings)

Figures 5A, 5B, 5C, 5D, 5E, 5F, 5G, 5H:
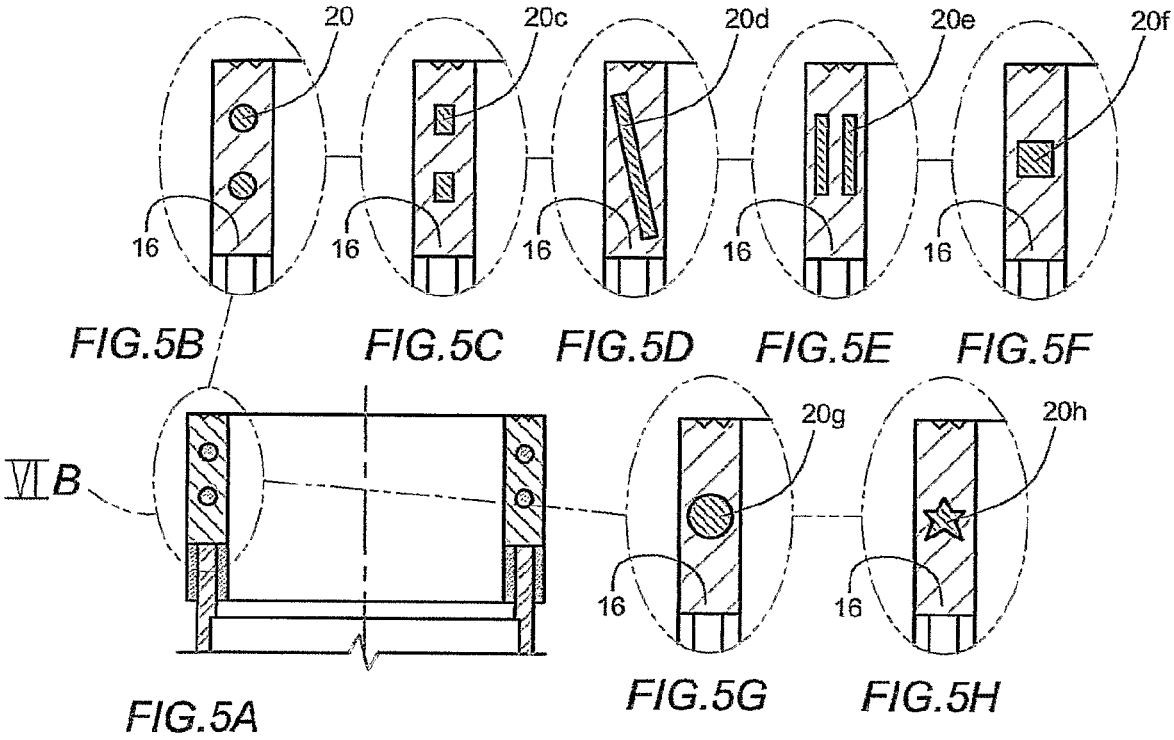
FIG. 5A, in a partial side cross-sectional view along the line III-III of FIG. 2, illustrates the bit of FIG. 1.
FIG. 5B, in a side cross-sectional view, illustrates the detail VB of the drill bit of FIG. 5A.
FIG. 5C, in a side cross-sectional view, illustrates a region corresponding to the detail VB in a bit in accordance with an alternative embodiment of the present invention having alternative reinforcing members extending within slots of a crown of the drill bit.
FIG. 5D, in a side cross-sectional view, illustrates a region corresponding to the detail VB in a bit in accordance with another alternative embodiment of the present invention having other alternative reinforcing members extending within slots of a crown of the drill bit.
FIG. 5E, in a side cross-sectional view, illustrates a region corresponding to the detail VB in a bit in accordance with yet another alternative embodiment of the present invention having yet other alternative reinforcing members extending within slots of a crown of the drill bit.
FIG. 5F, in a side cross-sectional view, illustrates a region corresponding to the detail VB in a bit in accordance with yet another alternative embodiment of the present invention having yet other alternative reinforcing members extending within slots of a crown of the drill bit.
FIG. 5G, in a side cross-sectional view, illustrates a region corresponding to the detail VB in a bit in accordance with yet another alternative embodiment of the present invention having yet other alternative reinforcing members extending within slots of a crown of the drill bit.
FIG. 5H, in a side cross-sectional view, illustrates a region corresponding to the detail VB in a bit in accordance with yet another alternative embodiment of the present invention having yet other alternative reinforcing members extending within slots of a crown of the drill bit.

Referring to FIG. 2, in some embodiments of the invention, the reinforcing members 20 extend substantially circumferentially across the slots 16 between the slot first and second side walls 36 and 38. One, two or more reinforcing members 20 extend across at least some of the slots 16. For example, FIG. 3 shows an embodiment of the invention wherein two reinforcing members 20 are substantially longitudinally spaced apart relative to each other within each slot 16. FIG. 5E shows an embodiment of the invention wherein two reinforcing members 20*e* are substantially radially spaced apart relative to each other within each slot 16. FIGS. 5D, 5F, 5C and 5H show embodiments of the invention wherein only one reinforcing member 20*d*, 20*f*, 20*g* and 20*h* extends within each slot 16.

The reinforcing members 20 are substantially cylindrical. However, as described in further details hereinbelow, the reinforcing members 20 may have other suitable shapes.

As seen on FIG. 3, in some embodiments of the invention, the reinforcing members 20 are spaced apart from the slot proximal wall 40 and from the crown distal end 28. In these embodiments, the slots 16 each include a slot proximal segment 42 extending between the reinforcing member 20 and the slot proximal wall 40 and a slot distal segment 44 extending between the reinforcing member 20 and the crown distal end 28. The reader skilled in the art will readily appreciate that the slot distal and proximal segments 44 and 42 have been defined with respect with one of the reinforcing members 20 extending across one of the slots 16. However, slot segments may be defined relatively to other reinforcing member 20 extending across this slot 16.

The reinforcing members 20 extend substantially radially within each slot 16 over a reinforcing member radial extension, the reinforcing member radial extension being substantially smaller than the crown radial thickness. Typically, the reinforcing member radial extension is from about 1 percent to about 90 percents of the crown radial thickness.

Indeed, if the reinforcing members 20 had a reinforcing member radial extension substantially equal to the crown radial thickness, there would be a moment during the wearing out of the crown 14 at which the whole circumference of the crown 14 would be in contact with the material through which a hole is drilled. Typically, this situation would result in relatively inefficient drilling.

In some embodiments of the invention, the reinforcing member radial extension is selected such that it is as small as possible while providing a suitable degree of reinforcement of the crown 14. For example, and non-limitingly, it has been found that reinforcing member radial extensions of from about 20 percents to about 50 percents of the crown radial thickness produce good results. In terms of absolute dimensions, and non-limitingly, it has been found that reinforcing member radial extensions of from about 1.5 mm to about 5 mm produce good results.

In some embodiments the reinforcing member longitudinal dimension must be sufficiently small to allow water and drilling debris to flow radially within the slots 16 at a sufficient rate. For example, and non-limitingly, it has been found that reinforcing members 20 extending substantially longitudinally within the slots 16 over a reinforcing member longitudinal dimension smaller than about 25 percent of a distance between the crown distal end 28 and the slot proximal wall 40 produce good results in operation.

Typically, the bit 10 is manufactured using graphite molds. For example, such a mold is substantially annular. Within the mold, inserts are provided at locations corresponding to the slots 16. Then, a mixture of metal and diamonds in a powder form is inserted within the mold and pressure is applied onto the mixture to squeeze the particles forming the powder together.

After the powder has been tightened, the segments are infiltrated with a compatible brazing alloy at a predetermined temperature. This infiltration process confers solidity to the crown 14, as the brazing alloy acts as a binder for the metal and diamonds particles. In addition, the brazing alloy also reinforces a link between the crown 14 and the support member 12.

The reinforcing members 20 are formed by using inserts shaped substantially similarly to the slots 16, each insert including one or more bores having a shape substantially similar to the shape of a reinforcing member 20. Then, when pressure is applied onto the powder, the mixture of diamonds and metal flows into the bores and forms the reinforcing members 20.

In an alternative embodiment of the invention, the bores of the inserts are filled with the mixture that forms the reinforcing members 20. Then, filling the sections of the molds corresponding to the segments 18 produces the crown 14.

In yet another manner of manufacturing the bit 10, the segments 18 are manufactured separately and simply positioned within a mold with inserts including the reinforcing members 20. Subsequently, the powder is squeezed and brazing is performed as described hereinabove.

In yet another manner of manufacturing the bit 10, the segments 18 and the reinforcing members 20 are manufactured separately. The reinforcing members 20 are either manufactured using the same materials as those used in manufacturing the segments 18, or they are simply manufactured using a metal. Thereafter, the reinforcing members 20 are brazed, welded, soldered or otherwise secured to the segments 18.

Other steps performed in manufacturing the bit 10 are well known in the art and will therefore not be described in further details.

In addition to diamonds dispersed in a metal matrix, the crown 14 may be manufactured using any other suitable abrasive dispersed in a suitable matrix. For example, so-called artificial diamonds might be used. Also, in some embodiments of the invention, the matrix includes a composite material, such as for example carbon fibers in a suitable resin.

In use, the bit 10 is inserted at the end of a drilling apparatus and used to drill through rock, concrete or any other material. If required, water is forced through the passageway 26. The water lubricates the contact between the bit 10 and the material being drilled and carries the debris produced by the drilling process away from the bit 10. To that effect, the at least part of the debris and the water passes through the slots 16.

The reinforcing members 20 improve the solidity of the drill bit 10. when the bit 10 is used, the segments 18 are progressively worn. When the segments 18 are worn up to a point wherein the crown distal surface 29 reaches the reinforcing members 20, the reinforcing members 20 are eroded along with the segments 18.

After the reinforcing members 20 have been worn out, the segments 18 extend away from the support member 12 over a distance small enough that the risk of breaking the segments 18 by the drilling process is significantly reduced.

In a specific example of implementation, it was possible to manufacture bits similar to the bit 10 with slots 16 that were 16 mm deep. These bit were at least as strong and at least as resistant to accidental damage to the segments 18 as a bit that did not include reinforcing members 20 but that had slots of a depth of only 12 mm.

Figure 4A:
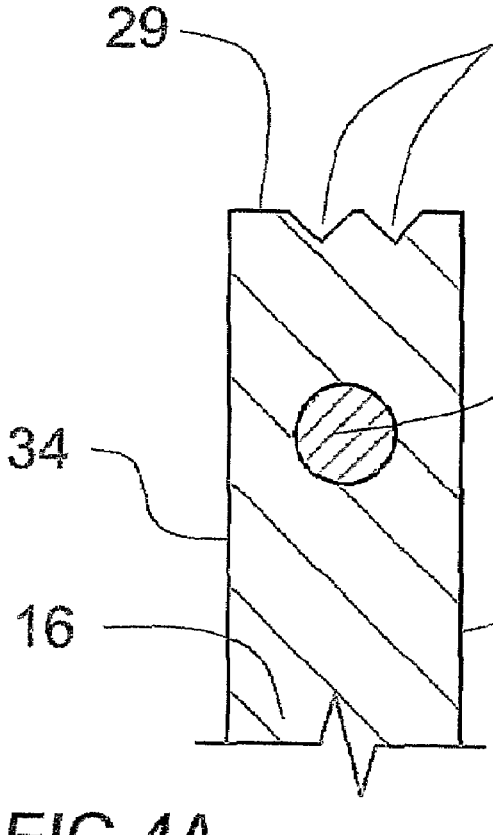
FIG. 4A, in a partial side cross-sectional view along the line III-III of FIG. 2, illustrates a stage in the wearing out of the bit of FIG. 1.
Figure 4B:
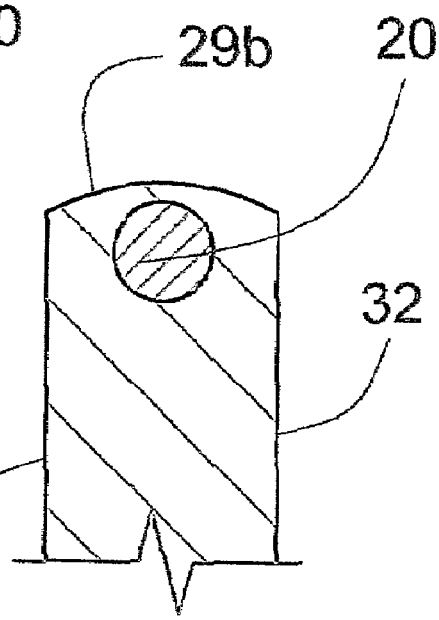
FIG. 4B, in a partial side cross-sectional view along the line III-III of FIG. 2, illustrates another stage in the wearing out of the bit of FIG. 1.

FIGS. 4A to 4D illustrate an example of wearing out of the bit 10 wherein uneven wear is produces. In FIG. 4A, the bit 10 has not been used. After some use, as seen in FIG. 4B, the bit 10 is worn out so that a crown distal surface 29*b* is convex between the crown inner and outer surfaces 32 and 34. This convex shape is undesirable as it affects the drilling performance of the bit 10.

Figure 4C:
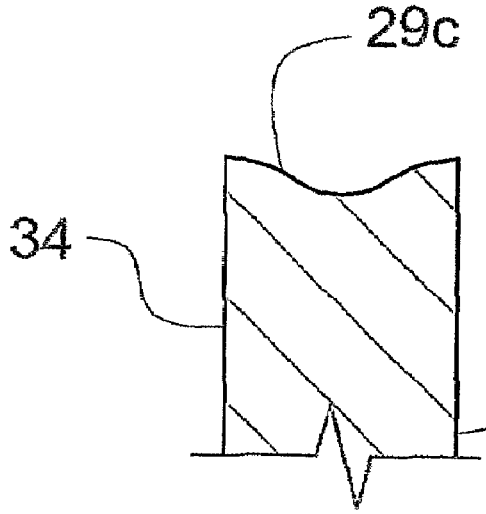
FIG. 4C, in a partial side cross-sectional view along the line III-III of FIG. 2, illustrates yet another stage in the wearing out of the bit of FIG. 1.
Figure 4D:
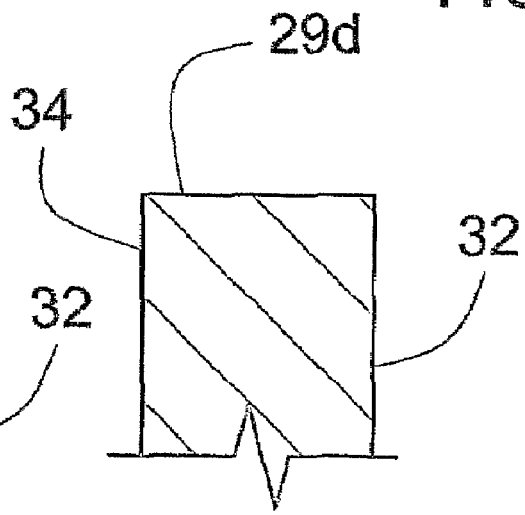
FIG. 4D, in a partial side cross-sectional view along the line III-III of FIG. 2, illustrates yet another stage in the wearing out of the bit of FIG. 1.

It has been observed that when the crown distal surface 29*b* reaches the reinforcing member 20, further use of the drill accelerates the wear of the portion of the crown 14 located at the radial location of the reinforcing member 20. After the reinforcing member has been abraded, a crown distal surface 29*c* is convex between the crown inner and outer surfaces 32 and 34, as seen in FIG. 4C. Further use of the bit 10 results in an increase in wear adjacent the crown inner and outer surfaces 32 and 34, which produces a substantially flat crown distal surface 29*d*, as seen in FIG. 4D.

It is hypothesized that this evening out of the wear of the crown in a radial direction is produced by an increase in the heat produced in the crown by the reinforcing member 20. However, other mechanisms may be involved in the production of this result.

FIGS. 5C through 5H illustrate the cross-section of alternative reinforcing members 20*c* through 20*h*. The reinforcing members 20*c* through 20*h* are all substantially elongated and of substantially uniform cross-section.

The reinforcing members 20*c* are of a substantially rectangular cross-section. The reinforcing members 20*f* are of a substantially square cross-section. The reinforcing members 20*d* are substantially plate-shaped and extend at an angle relatively to a longitudinal axis of the bit 10. The reinforcing members 20*e* are substantially plate-shaped and extend substantially longitudinally. The reinforcing members 20*h* are of a substantially star-shaped cross-section.

The reader skilled in the art will readily appreciate that the examples of reinforcing members 20 and 20*c* through 20*h* are only examples and that many other suitable reinforcing members are within the scope of the invention. For example, reinforcing members having alternative uniform cross-sections and reinforcing members having non-uniform cross-sections are also within the scope of the invention.

Figure 6A:
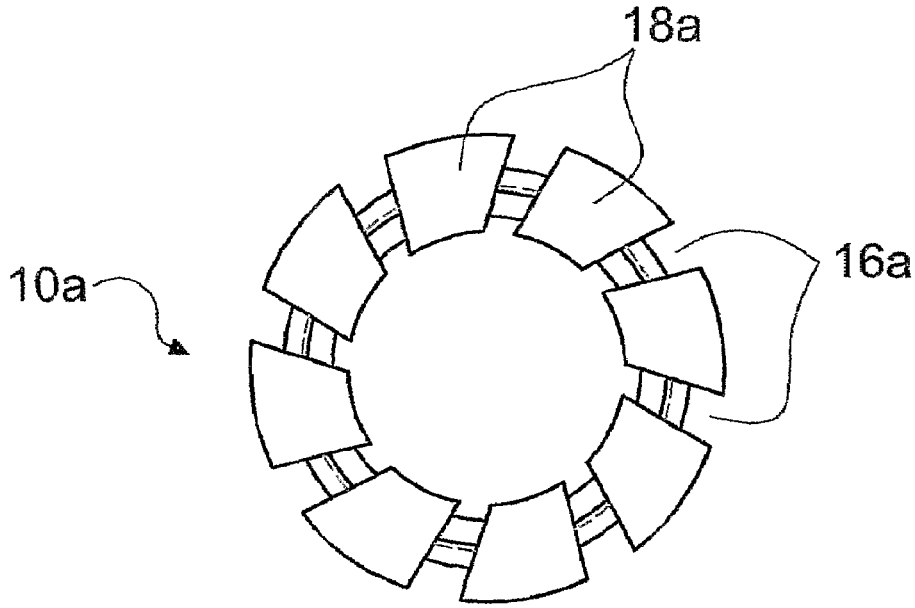
FIG. 6A, in a top elevation view, illustrates a bit in accordance with an alternative embodiment of the present invention having alternatively shaped slots formed into a crown of the drill bit.
Figure 6B:
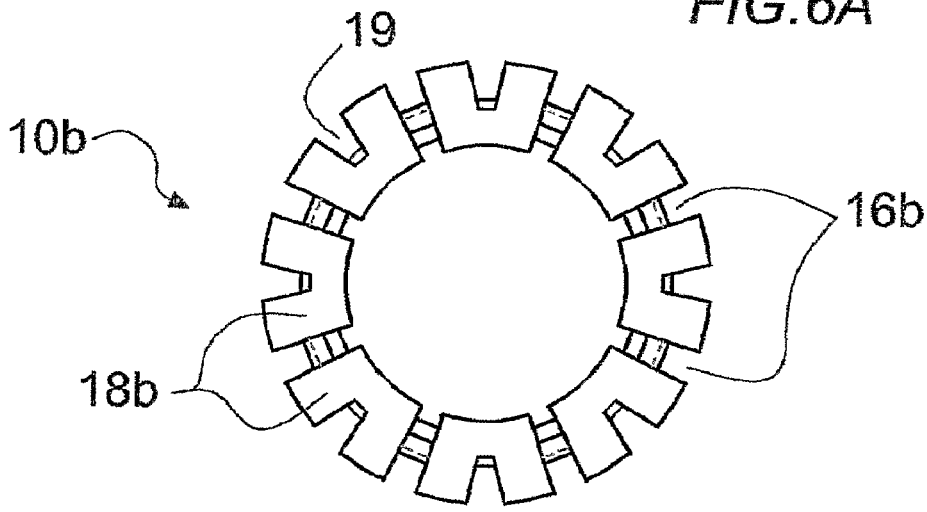
FIG. 6B, in a top elevation view, illustrates a bit in accordance with another alternative embodiment of the present invention having other alternatively shaped slots formed into a crown of the drill bit.
Figure 6C:
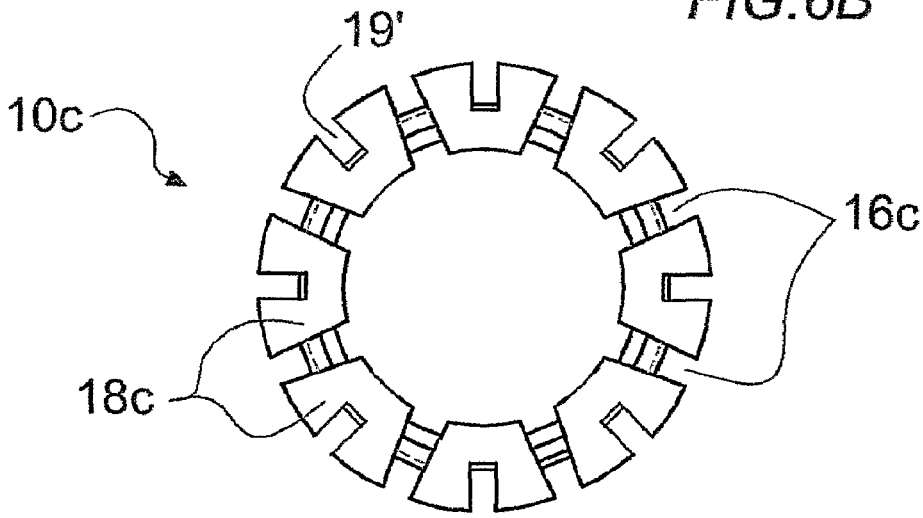
FIG. 6C, in a top elevation view, illustrates a bit in accordance with yet another an alternative embodiment of the present invention having yet other alternatively shaped slots formed into a crown of the drill bit.

FIGS. 6A, 6B and 6C illustrate alternative slots 16*a*, 16*b* and 16*c* and alternative segments 18*a*, 18*b* and 18*c* of alternative bits 10*a*, 10*b* and 10*c*. The slots 16*a* do not extend perfectly radially. Instead, the slots 16*a* are angled relatively to radiuses of the bit 10*a*. The slots 16*b* are similar to the slots 16. The slots 16*c* are tapered in a radially outwardly directed orientation.

The segments 18*a* have a shape different than the segments 18 because of difference in shape between the slots 16 and 16*a*. The segments 18*b* and 18*c* each have a radially outwardly located outer groove 19 and 19' formed longitudinally thereinto.

The illustrated slot and segments shapes shown in FIGS. 6A, 6B and 6C are well-known in the art and will therefore not be described in further details. Also, the segments and slots may take any other alternative shapes in alternative embodiments of the invention.

Although the present invention has been described hereinabove by way of preferred embodiments thereof, it can be modified, without departing from the spirit and nature of the subject invention as defined in the appended claims.

What is claimed is:

1. A bit for drilling a hole, said bit comprising;

a support member, said support member defining a support member proximal end and a substantially longitudinally opposed support member distal end, said support member having a passageway extending substantially longitudinally therethrough;

a substantially annular crown defining a crown distal end and an opposed crown proximal end, a radially inwardly located crown inner surface and a radially outwardly located crown outer surface, a crown inner diameter and a crown outer diameter, said crown extending from said support member such that said crown proximal end is located substantially adjacent said support member distal end;

a slot extending between said crown inner and outer surfaces from said crown distal end substantially longitudinally towards said crown proximal end, said slot defining a slot first side wall, a substantially circumferentially opposed slot second side wall and a slot proximal wall extending therebetween substantially opposed said crown distal end; and a reinforcing member extending substantially circumferentially across said slot between said slot first and second side walls;

wherein said slot includes a slot proximal segment extending between said reinforcing member and said slot proximal wall and a slot distal segment extending between said reinforcing member and said crown distal end.

2. A bit as defined in claim 1, wherein said support member is substantially tubular and cylindrical, said support member defining support member internal and external diameters, said crown outer diameter being substantially larger than said support member outer diameter and said crown inner diameter being substantially smaller than said support member inner diameter.

3. A bit as defined in claim 2, wherein said crown has a crown radial thickness equal to a difference between said crown outer and inner diameters, said reinforcing member having a reinforcing member radial thickness over which said reinforcing member extends substantially radially inside said slot, said reinforcing member radial thickness being substantially smaller than said crown radial thickness.

4. A bit as defined in claim 3, wherein said reinforcing member radial thickness is from about 1 percent to about 90 percents of said crown radial thickness.

5. A bit as defined in claim 3, wherein said reinforcing member radial thickness is from about 20 percents to about 50 percents of said crown radial thickness.

6. A bit as defined in claim 3, wherein said reinforcing member extends substantially longitudinally within said slot over a reinforcing member longitudinal thickness, said reinforcing member longitudinal thickness being smaller than about 25 percent of a distance between said crown distal end and said slot proximal wall.

7. A bit as defined in claim 3, further comprising another reinforcing member extending substantially circumferentially across said slot between said slot first and second side walls, said two reinforcing members being substantially longitudinally spaced apart relative to each other within said slot.

8. A bit as defined in claim 3, further comprising another reinforcing member extending substantially circumferentially across said slot between said slot first and second side walls, said two reinforcing members being substantially radially spaced apart relative to each other within said slot.

9. A bit as defined in claim 3, wherein said reinforcing member is substantially cylindrical.

10. A bit as defined in claim 3, wherein said reinforcing member is an extrusion having a reinforcing member cross-section selected from the group consisting of: a substantially square cross-section, a substantially rectangular cross-section and a substantially star-shaped cross-section.

11. A bit as defined in claim 3, wherein said slot extends substantially radially between said crown inner and outer surfaces.

12. A bit as defined in claim 3, wherein said slot extends is angled relatively to a radial direction between said crown inner and outer surfaces.

13. A bit as defined in claim 3, wherein said slot is substantially tapered from said crown inner surface towards said crown outer surface.

14. A bit as defined in claim 3, wherein said slot is substantially tapered from said crown outer surface towards said crown inner surface.

15. A bit as defined in claim 3, wherein said slot first and second side walls are substantially parallel relative to each ocher.

16. A bit as defined in claim 3, wherein said crown inner and outer surfaces arc substantially cylindrical and said crown defines a crown distal surface at said crown distal end, said crown distal surface being substantially perpendicular to said crown inner and outer surfaces.

17. A bit as defined in claim 16, wherein said crown includes substantially annular grooves formed into said crown distal surface.

18. A bit as defined in claim 3, wherein said crown includes diamonds dispersed in a metallic substrate.

19. A bit as defined in claim 1, further comprising a plurality of slots each extending between said crown inner and outer surfaces from said crown distal end substantially longitudinally towards said crown proximal end, each of said slot defining a respective slot first side wall, a respective substantially circumferentially opposed slot second side wall and a respective slot proximal wall extending therebetween substantially opposed said crown distal end; and a plurality of reinforcing members each extending substantially circumferentially across a respective one of said slots between said slot first and second side walls.

* * * * *